US008881455B2

(12) United States Patent
Ro et al.

(10) Patent No.: US 8,881,455 B2
(45) Date of Patent: Nov. 11, 2014

(54) AUTOMATICALLY CLOSED FIRE PROTECTION LOUVER DEVICE

(75) Inventors: Yoo Sun Ro, Seoul (KR); Young Gon Ro, Seoul (KR)

(73) Assignee: GL World Tech C&S Ltd. Co., Seoul (KR)

( * ) Notice: Subject to any disclaimer, the term of this patent is extended or adjusted under 35 U.S.C. 154(b) by 0 days.

(21) Appl. No.: 13/879,789

(22) PCT Filed: Oct. 10, 2011

(86) PCT No.: PCT/KR2011/007484

§ 371 (c)(1), (2), (4) Date: Apr. 16, 2013

(87) PCT Pub. No.: WO2012/053760

PCT Pub. Date: Apr. 26, 2012

(65) Prior Publication Data

US 2013/0199736 A1 Aug. 8, 2013

(30) Foreign Application Priority Data

Oct. 20, 2010 (KR) ..... 10-2010-0102385

(51) Int. Cl.
*E04F 10/10* (2006.01)
*E06B 7/086* (2006.01)

(52) U.S. Cl.
CPC ..... *E04F 10/10* (2013.01); *E06B 7/086* (2013.01)
USPC ..... 49/7; 49/8

(58) Field of Classification Search
CPC ..... F24F 2011/0098; F24F 2013/144; F24F 11/053; A62C 2/14; E06B 7/084
USPC ..... 49/1–8, 31, 74.1, 79.1, 89.1, 91.1, 92.1
See application file for complete search history.

(56) References Cited

U.S. PATENT DOCUMENTS

| | | | | | |
|---|---|---|---|---|---|
| 1,573,930 | A | * | 2/1926 | Gilmore | 49/4 |
| 1,871,161 | A | * | 8/1932 | Dickson | 49/7 |
| 2,554,822 | A | * | 5/1951 | Geier | 49/8 |
| 2,732,920 | A | * | 1/1956 | Newton | 16/48.5 |
| 2,954,728 | A | * | 10/1960 | Smith | 49/1 |
| 3,260,018 | A | * | 7/1966 | Schuh | 49/7 |
| 3,350,996 | A | * | 11/1967 | Rose | 454/278 |
| 3,543,439 | A | * | 12/1970 | Pantland | 49/7 |
| 3,543,440 | A | * | 12/1970 | Kurz | 49/7 |
| 3,571,973 | A | * | 3/1971 | Roberts | 49/2 |
| 3,591,221 | A | * | 7/1971 | Alley | 160/1 |
| 3,832,940 | A | * | 9/1974 | Hess | 454/335 |

(Continued)

FOREIGN PATENT DOCUMENTS

| | | |
|---|---|---|
| JP | 05-052076 | 3/1993 |
| KR | 10-2006-0076921 | 7/2006 |
| KR | 10-0668113 | 1/2007 |
| KR | 10-0846145 | 7/2008 |

*Primary Examiner* — Katherine Mitchell
*Assistant Examiner* — Justin Rephann
(74) *Attorney, Agent, or Firm* — John K. Park; Park Law Firm

(57) ABSTRACT

The present invention provides an automatically closed fire protection louver device, which is installed on a window or the like in an apartment building without a balcony function or in a curtain wall type building structure to adjust natural lighting and automatically block spread of flames to an upper floor without using electrical energy when a fire breaks out.

8 Claims, 4 Drawing Sheets

(56) References Cited

U.S. PATENT DOCUMENTS

| | | | | | |
|---|---|---|---|---|---|
| 3,951,051 | A | * | 4/1976 | Dry | 454/357 |
| 3,996,952 | A | * | 12/1976 | Root | 137/77 |
| 4,068,417 | A | * | 1/1978 | Anghinetti et al. | 52/1 |
| 4,080,978 | A | * | 3/1978 | McCabe | 137/79 |
| 4,081,173 | A | * | 3/1978 | McCabe | 251/308 |
| 4,184,288 | A | * | 1/1980 | Magill et al. | 49/7 |
| RE30,204 | E | * | 2/1980 | Root | 137/77 |
| 4,301,569 | A | * | 11/1981 | McCabe | 16/48.5 |
| 4,452,010 | A | * | 6/1984 | Whittington et al. | 49/51 |
| 4,487,214 | A | * | 12/1984 | Tatum | 137/72 |
| 4,581,987 | A | * | 4/1986 | Ulicny | 454/369 |
| 4,627,498 | A | * | 12/1986 | Aalto et al. | 169/42 |
| 4,723,481 | A | * | 2/1988 | Hart et al. | 454/369 |
| 5,020,423 | A | * | 6/1991 | Hill | 454/319 |
| 5,619,821 | A | * | 4/1997 | St. George et al. | 49/57 |

* cited by examiner (a) (b) (c)

AUTOMATICALLY CLOSED FIRE PROTECTION LOUVER DEVICE

BACKGROUND OF THE INVENTION

1. Field of the Invention

The present invention relates to an automatically closed fire protection louver device, which is installed on a window or the like in an apartment building without a balcony function or in a curtain wall type building structure to adjust natural lighting and automatically block spread of flames to an upper floor without using electrical energy when a fire breaks out.

2. Background of the Related Art

FIG. 1 is a conceptual view showing states of flames moving up to an upper floor when a fire breaks out at a lower floor in a multi-story building, and FIG. 2 is a view showing an example of a multi-story building recently damaged by flames moving up to an upper floor through an external window.

A window WD is a constructional component that is necessarily required for natural lighting and ventilation. However, it functions as a decisive passage for moving flames F of a lower floor to an upper floor along an outer wall in a multi-story building when a fire breaks out.

This is since that the flames F move up along the outer wall of the building and spread through the windows WD of the upper floor when the flames burst up outside of the building as shown in FIG. 1(*a*).

As shown in FIGS. 1(*b*) and 1(*c*), a fundamental method for preventing spread of flames F is preventing the flames F from reaching the windows of an upper floor by constructing a balcony B or a waist-high wall W. Particularly, since the balcony B may be used as a space for evacuation in an emergency situation while providing a cozy indoor environment by blocking direct sunlight, as well as performing a function of preventing spread of flames as described above, balconies are generally applied in all kinds of building structures including existing apartments.

However, the balcony B that should be open and exposed to outside is blocked using a window to prevent dusts and noises caused by environmental pollution and used as a space for stacking things like a barn or illegally renovated as an indoor space.

As the illegal renovation of the balcony is much in vogue, renovation of balcony is allowed by law in Korea from 2006 in the end, and thus renovation of balcony is generalized in most of apartments thereafter.

As a result, since a curtain wall type outer wall has become a main stream in a lot of high-rise buildings, building space is increased as the balcony B or the waist-high wall W is disappeared, but the structure is vulnerable to fire and disadvantageous for natural lighting.

In the case of an apartment without a balcony B or a curtail wall type building, sunlight flows into a room without being filtered and temperature of the room goes up in summer, and this works as a major cause of using cooling devices consuming much power. Since an amount of power required at a peak time should be reserved, use of the cooling devices in summer when power is consumed most is a great loss from an economical viewpoint and generates a large amount of carbon dioxide from an environmental viewpoint. Accordingly, in recent days when prevention of global warming accomplished by saving energy and reducing generation of carbon dioxide is emerged as a global issue, an effective solution for particularly reducing use of cooling device is required.

A method of blocking sunlight includes (1) a method of fundamentally blocking sunlight from outside of a room using a balcony or an awning, (2) a method of blocking sunlight within a room using a curtain or a blind, and (3) a method of blocking sunlight using a double window having a special-purpose glass or blind, which is so-called as a low-E glass, installed inside thereof. Among these methods, the most effective method for suppressing increase of temperature in a room caused by sunlight is method (1), i.e., the method of blocking sunlight from outside of a room. In addition, a view for seeing a landscape is hindered in order to block the sunlight in the case of methods (2) and (3), but method (1) is advantageous in that the sunlight can be blocked while a view for seeing a landscape is not hindered.

Installing an awning is the easiest method for blocking sunlight from outside of a room in an apartment without a balcony function or a curtain wall type building. (1) Although a canopy type awning is cheap and easy to install, it has a problem of low durability and unfavorable appearance and is disadvantageous in that safety is lowered as being affected by a horizontal load such as wind due to high rise of the apartment. Meanwhile, (2) although a louver type awning is appropriate for a high-rise building or a curtail wall type building since it has a beautiful appearance and is less affected by the wind, it is less frequently used due to low awareness.

For such a louver, the inventor of the present invention has devised a non-powered louver device using an expansion material and filed a patent application, in which optimal natural lighting is allowed according to the season by rotating a blade without using power in consideration of even energy efficiency. (Korean Patent Application No. 10-2010-0003879)

However, since all louver devices of the prior art including the above application are developed to be applied in a building designed and constructed after 2008 when installation of sprinklers and fire protection glasses is mandated by law, and they do not specially take into account fire protection, inconvenience of difficulties in applying the louver devices to an existing building has been pointed out.

The reason is that since the louvers are open in the vertical direction in order to block sunlight while being less affected by the wind, they do not have the capability of blocking flames like the balcony B in the case where the flames spread to an upper floor along the outer wall of a building when a fire breaks out.

In recent days, there are many actual cases of being greatly damaged by flames spreading to an upper floor since balconies B are not constructed in a building as shown in FIG. 2. Particularly, high-rise buildings of 15 stories or higher are always confronted with danger of fire since a fire cannot be extinguished by existing water sprinkling vehicles, and a solution for this problem is required.

Therefore, the inventor of the present invention has developed a louver device which is effective for natural lighting and has a fire protection function of automatically blocking flames spreading to an upper floor without using electrical energy when a fire breaks out, while maintaining advantages of a louver.

SUMMARY OF THE INVENTION

Therefore, the present invention has been made in view of the above problems, and the objects of the present invention are as described below.

First, there is provided an automatically closed fire protection louver device, which automatically blocks flames of a lower floor spreading to an upper floor without using electrical energy when a fire breaks out in an apartment building without a balcony or a curtain wall type building.

Second, there is provided an automatically closed fire protection louver device, which can enhance thermal energy efficiency by effectively adjusting natural lighting according to the season and provide a cozy indoor environment.

Third, there is provided an automatically closed fire protection louver device, which does not require maintenance cost since power such as electrical energy is not needed and does not need continuous maintenance since it is not easily broken due to simple structure.

Fourth, there is provided an automatically closed fire protection louver device, which can be installed in an existing building as is without separately changing a design.

To accomplish the above objects, according to one aspect of the present invention, there is provided an automatically closed fire protection louver device, which is installed on an outer surface of a wall or outside of a window WD, the louver device including: a control unit 300 including a main body 310 formed in a shape of a pipe having a front end hollow 313 and a rear end hollow 315, which are hollows, respectively formed at a front end and a rear end, in which a portion of a lower part is open to form a fuse room 311 connected to the front end hollow 313, and a plurality of control pins 360 is formed at an upper part in a row, a fuse 330 inserted in the fuse room 311 and broken by heat F at a predetermined temperature, a front side fixing rod 320 inserted in the front end hollow 313, having a rear end tightly attached to the fuse 330 and a front end exposed to outside of the front end hollow 313, a spring 340 inserted in the rear end hollow 315, and a rear side fixing rod 350 inserted in the rear end hollow 315, having a front end tightly attached to the spring 340 in a state of maintaining a compressive force of the spring 340 and a rear end exposed to outside of the rear end hollow 315; a plurality of blades 200 formed in a shape of a plate as a whole, in which each of the blades has a blade rotation axis 201 protruded at both ends, and a blade lower portion 220 is rested or hinge-coupled in a space between the control pins 360; and an exterior frame 100 configured of a front side plate 120 formed with a front side fixing rod insertion hole 122 at the center so that a front end of the front side fixing rod 320 may be inserted and fixed in the front side fixing rod insertion hole 122, a rear side plate 130 formed with a rear side fixing rod insertion hole 132 at the center so that a rear end of the rear side fixing rod 350 may be inserted and fixed in the rear side fixing rod insertion hole 132, and two side plates 110 respectively formed with a plurality of blade rotation axis insertion holes 111 at regular intervals in a row so that the blade rotation axis 201 may be inserted and rotated, in which both ends of each side plate are installed to be respectively attached to an end of the front side plate 120 and an end of the rear side plate 130, in which if heat F is applied to the fuse 330 when a fire breaks out, the fuse 330 is broken, and the main body 310 moves forward by the spring 340 so that the blade lower portion 220 rested or hinge-coupled in a space between the control pins 360 may move together with the main body 310, and thus the blade 200 is rotated and closed.

In addition, since the cross section of the blade 20 is formed in an "S" shape as a whole by bending the blade upper portion 210 of the blade 200 backward and bending the blade lower portion 220 forward, the blade upper portion 210 of a fore blade 200 contacts with the blade lower portion 220 of a hind blade 200 so as to be tightly closed when the blades 200 are closed.

DESCRIPTION OF SYMBOLS

Figure 1:
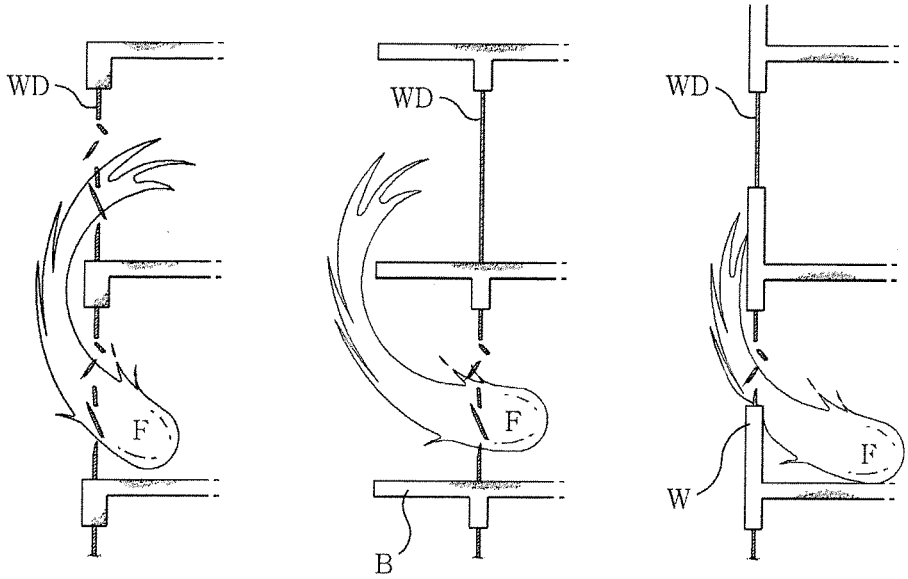
FIG. 1 is a conceptual view showing states of flames moving up to an upper floor when a fire breaks out at a lower floor in a multi-story building.
Figure 2:
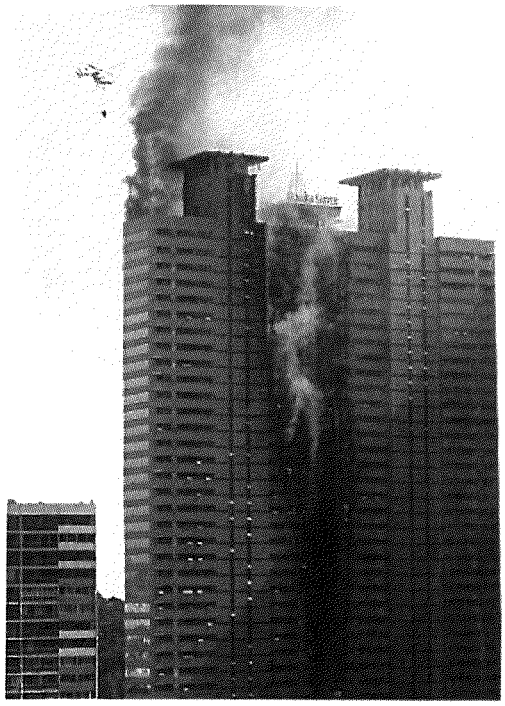
FIG. 2 is a view showing an example of a multi-story building recently damaged by flames moving up to an upper floor through an external window.

| | |
|---|---|
| B: Balcony | F: Heat, Fire, Flame |
| W: Waist-high wall | WD: Window |
| 100: Exterior frame | 110: Side plate |
| 111: Blade rotation axis insertion hole | |
| 112: Blade holder | 120: Front side plate |
| 121: Blade lower portion fixing step | |
| 122: Front side fixing rod insertion hole | |
| 130: Rear side plate | |
| 131: Blade upper portion fixing step | |
| 132: Rear side fixing rod insertion hole | |
| 200: Blade | 201: Blade rotation axis |
| 202: Groove | 210: Blade upper portion |
| 220: Blade lower portion | 300: Control unit |
| 310: Main body | 311: Fuse room |
| 313: Front end hollow | 315: Rear end hollow |
| 320: Front side fixing rod | |
| 321: Front side fixing rod male screw unit | |
| 322: Front side fixing rod adjustment unit | |
| 330: Fuse | 340: Spring |
| 350: Rear side fixing rod | |
| 351: Rear side fixing rod male screw unit | |
| 360: Control pin | 361: Blade fixing unit |
| 362: Blade pusher | |

DETAILED DESCRIPTION OF THE PREFERRED EMBODIMENT

An automatically closed fire protection louver device of the present invention is a louver device installed on an outer surface of a wall or outside of a window WD, and the louver device includes a control unit 300 including a main body 310 formed in a shape of a pipe having a front end hollow 313 and a rear end hollow 315, which are hollows, respectively formed at a front end and a rear end, in which a portion of a lower part is open to form a fuse room 311 connected to the front end hollow 313, and a plurality of control pins 360 is formed at an upper part in a row, a fuse 330 inserted in the fuse room 311 and broken by heat F at a predetermined temperature, a front side fixing rod 320 inserted in the front end hollow 313, having a rear end tightly attached to the fuse 330 and a front end exposed to outside of the front end hollow 313, a spring 340 inserted in the rear end hollow 315, and a rear side fixing rod 350 inserted in the rear end hollow 315, having a front end tightly attached to the spring 340 in a state of maintaining a compressive force of the spring 340 and a rear end exposed to outside of the rear end hollow 315; a plurality of blades 200 formed in a shape of a plate as a whole, in which each of the blades has a blade rotation axis 201 protruded at both ends, and a blade lower portion 220 is rested or hinge-coupled in a space between the control pins 360; and an exterior frame 100 configured of a front side plate 120 formed with a front side fixing rod insertion hole 122 at the center so that a front end of the front side fixing rod 320 may be inserted and fixed in the front side fixing rod insertion hole 122, a rear side plate 130 formed with a rear side fixing rod insertion hole 132 at the center so that a rear end of the rear side fixing rod 350 may be inserted and fixed in the rear side fixing rod insertion hole 132, and two side plates 110 respectively formed with a plurality of blade rotation axis insertion holes 111 at regular intervals in a row so that the blade rotation axis 201 may be inserted and rotated, in which both ends of each side plate are installed to be respectively attached to an end of the front side plate 120 and an end of the rear side plate 130, in which if heat F is applied to the fuse 330 when a fire breaks out, the fuse 330 is broken, and the main body 310 moves forward by the spring 340 so that the blade lower portion 220 rested or hinge-coupled in a space between the control pins 360 may move together with the main body 310, and thus the blade 200 is rotated and closed.

Hereinafter, the present invention will be described in further detail through an embodiment preferably implementing the concept of the present invention with reference to the accompanying drawings.

Figure 3:
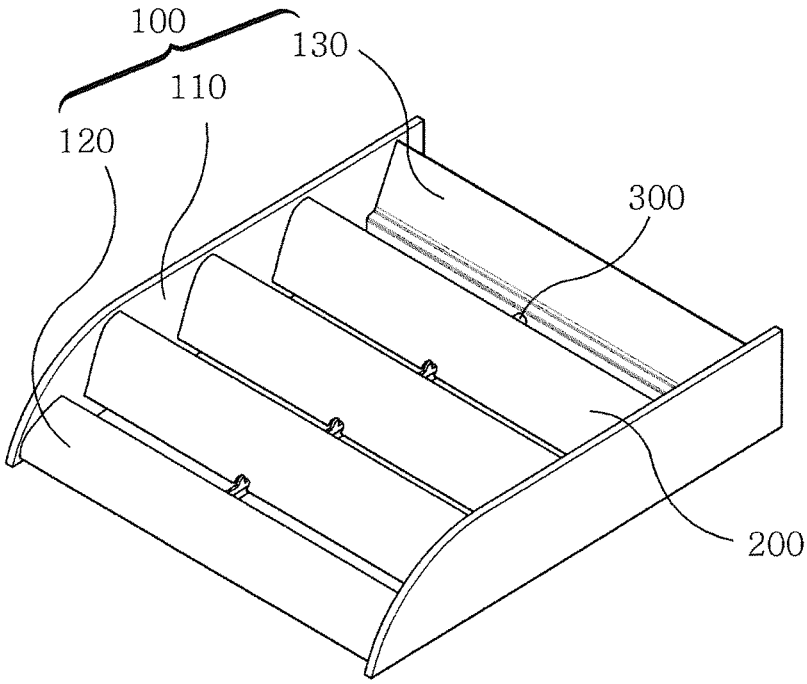
FIG. 3 is a combined perspective view showing an open state of an automatically closed fire protection louver device of the present invention in normal times.
Figure 4:
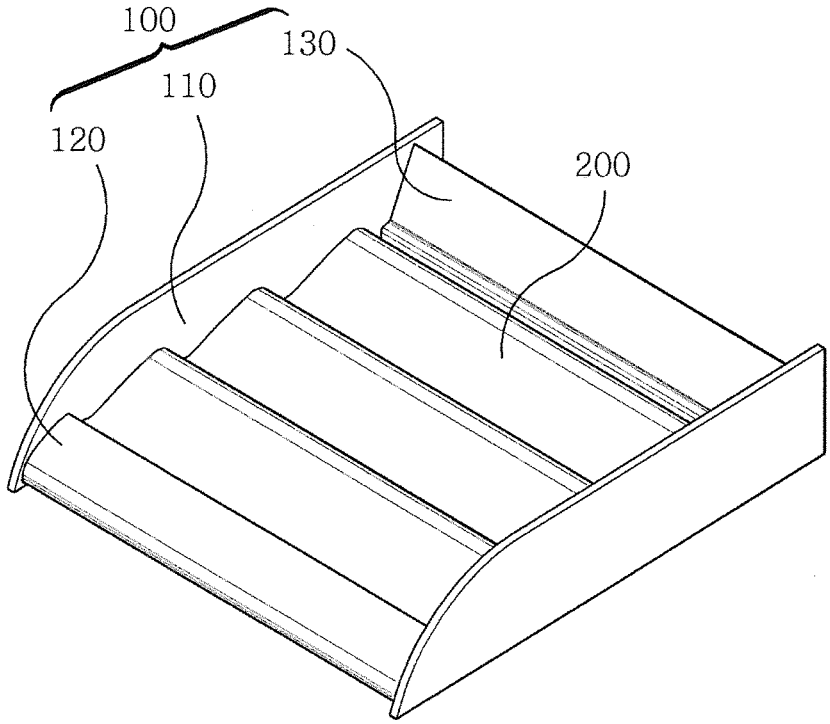
FIG. 4 is a combined perspective view showing a closed state of an automatically closed fire protection louver device of the present invention when a fire breaks out.
Figure 5:
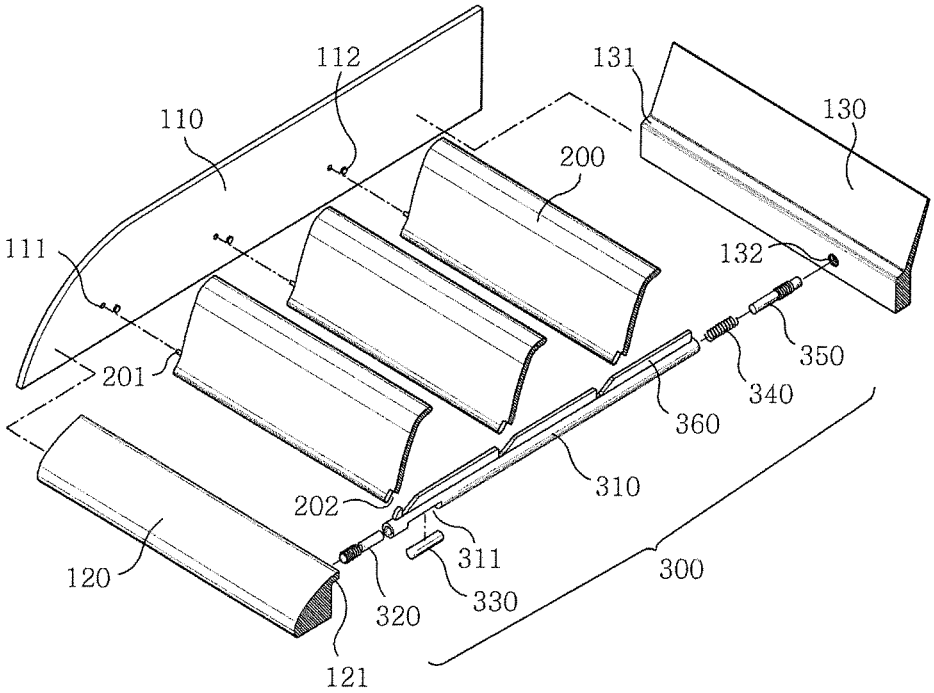
FIG. 5 is an exploded perspective view showing an automatically closed fire protection louver device of the present invention.

FIG. 3 is a combined perspective view showing an open state of an automatically closed fire protection louver device of the present invention in normal times, FIG. 4 is a combined perspective view showing a closed state of an automatically closed fire protection louver device of the present invention when a fire breaks out, and FIG. 5 is an exploded perspective view showing an automatically closed fire protection louver device of the present invention.

Constitutional components of the automatically closed fire protection louver device of the present invention are largely divided into a control unit 300, a blade 200 and an exterior frame 100.

The control unit 300 is largely divided into a main body 310, a fuse 330, a front side fixing rod 320 and a rear side fixing rod 350.

The main body 310 is formed in a shape of a pipe having a front end hollow 313 and a rear end hollow 315, which are hollows, respectively formed at a front end and a rear end, in which a portion of a lower part is open to form a fuse room 311 connected to the front end hollow 313, and a plurality of control pins 360 is formed at an upper part in a row.

The fuse 330 is inserted in the fuse room 311 and broken by heat F at a predetermined temperature. The fuse 330 is broken at a predetermined temperature or higher when a fire breaks out, and a glass bulb or a fusible link used for a sprinkler can be used as the fuse 330.

The front side fixing rod 320 is inserted in the front end hollow 313 and has a rear end tightly attached to the fuse 330 and a front end exposed to outside of the front end hollow 313. Since the front end of the front side fixing rod 320 is configured of a front side fixing rod male screw unit 321 and a front side fixing rod adjustment unit 322 and a female screw unit is formed in the front side fixing rod insertion hole 122, the front side fixing rod male screw unit 321 may be engaged in the front side fixing rod insertion hole 122.

The spring 340 is inserted in the rear end hollow 315 and provides overall power of the control unit 300 when a fire breaks out as is described below.

The rear side fixing rod 350 is inserted in the rear end hollow 315 and has a front end tightly attached to the spring 340 in a state of maintaining a compressive force of the spring 340 and a rear end exposed to outside of the rear end hollow 315. Since the rear end of the rear side fixing rod 350 is configured of a rear side fixing rod male screw unit 351 and a female screw unit is formed in the rear side fixing rod insertion hole 132, the rear side fixing rod male screw unit 351 may be engaged in the rear side fixing rod insertion hole 132.

If the front side fixing rod male screw unit 321 and the rear side fixing rod male screw unit 351 are turned like a screw, a tilt angle of the blade 200 may be adjusted to an angle effective for natural lighting according to the latitude and season.

A plurality of blades 200 is formed in a shape of a plate as a whole, in which each of the blades has a blade rotation axis 201 protruded at both ends, and a blade lower portion 220 is rested or hinge-coupled in a space between the control pins 360. The blade rotation axis 201 is installed to pass through a lower portion below the center in the cross section of the blade 200, toward the front side as much as possible, in order to raise the center of gravity so that the blade 200 may be easily rotated and closed by gravity. A metal applied or coated with an anticorrosive and fireproof paint is most appropriate as a material of the blade 200 like the exterior frame 100, and it is preferable to use a layered heat-resistant material such as ceramic on the rear side of the blade 200 in order to enhance fireproof performance.

The exterior frame 100 is largely configured of a front side plate 120, a rear side plate 130 and two side plates 110.

The front side plate 120 is formed with a front side fixing rod insertion hole 122 at the center so that the front end of the front side fixing rod 320 may be inserted and fixed in the front side fixing rod insertion hole 122.

The rear side plate 130 is formed with a rear side fixing rod insertion hole 132 at the center so that the rear end of the rear side fixing rod 350 may be inserted and fixed in the rear side fixing rod insertion hole 132.

The side plate 110 is formed with a plurality of blade rotation axis insertion holes ill at regular intervals in a row so that the blade rotation axis 201 may be inserted and rotated, and both ends of the side plate are installed to be respectively attached to an end of the front side plate 120 and an end of the rear side plate 130. A plurality of blade holders 112 may be further formed in a row to latch and fix a lower portion of an end of the blade 200 when the blade 200 is opened. The rear end of the side plate 110 is attached to an upper portion of the outside of a window so that the exterior frame 100 may be formed in a shape of a cantilever as a whole. The side plate 110 is formed in a shape of a plate, and although the cross section thereof may be formed in a variety of shapes, the cross section of the side plate is preferably formed in a rectangular shape for the convenience, an oval shape considering the effect of wind or an 'I' shape that is structurally advantageous.

A metal applied with an anticorrosive and fireproof paint is most appropriate as a material of the exterior frame 100 considering appearance, durability, structural stability, fireproof performance and the like, and the exterior frame 100 has a cross section that will not disrupt operation of the louver device when a fire breaks out. In addition, perforation processing can be performed like a rib of an airplane wing to achieve lightweightness.

The front end and the rear end of the control pin 360 are respectively further formed with a blade pusher 362 of an inclined shape and a cross-cut blade fixing unit 361, and a blade lower portion fixing step 121 and a blade upper portion fixing step 131 are further formed at the front side plate 120 and the rear side plate to face each other. Therefore, when the blade 200 is closed, the blade pusher 362 pushes up and fixes the blade lower portion 220 so that the blade lower portion 220 of the foremost blade 200 may contact with the blade lower portion fixing step 121 so as to be tightly closed and the blade upper portion 210 of the rearmost blade 200 may contact with the blade upper portion fixing step 131 so as to be tightly closed.

At this point, since the blade pusher 362 pushes up and firmly fixes the blade lower portion 220 by the tensile force of the spring 340, the blade 20 that is once closed will not be opened by an external force such as fire-wind or wind.

In addition, the blade lower portion 220 is cut to form a groove 202 so that the blade pusher 362 of the control pin 360 may be inserted.

Figure 6:
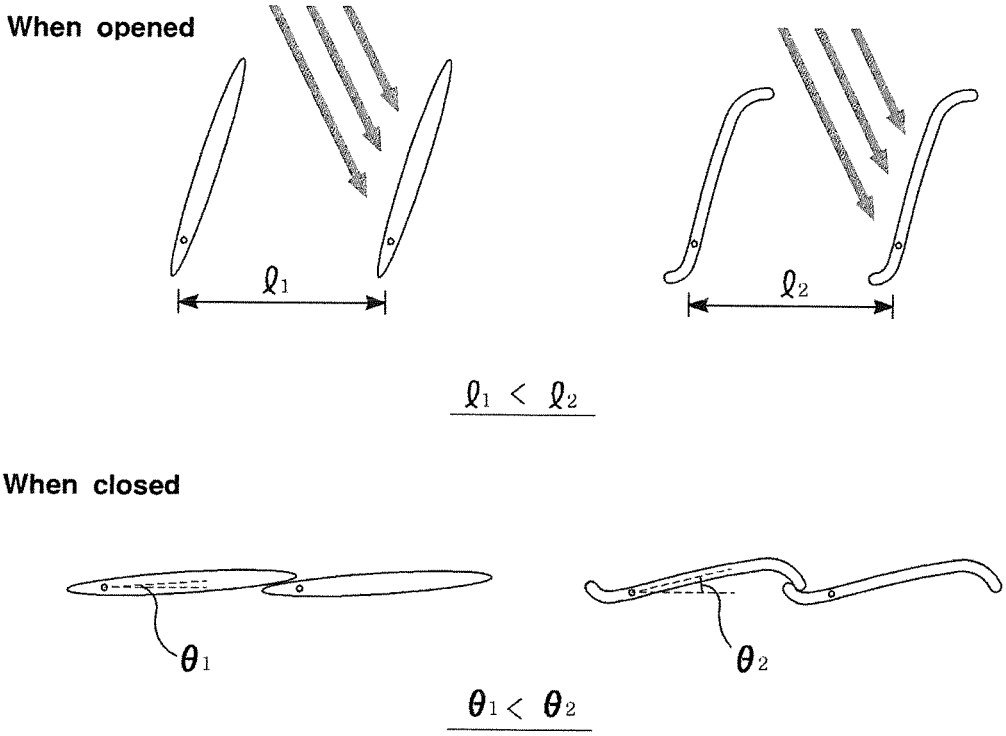
FIG. 6 is a conceptual view comparing advantages and disadvantages according to a cross sectional shape of a blade in an automatically closed fire protection louver device of the present invention.
Figure 7:
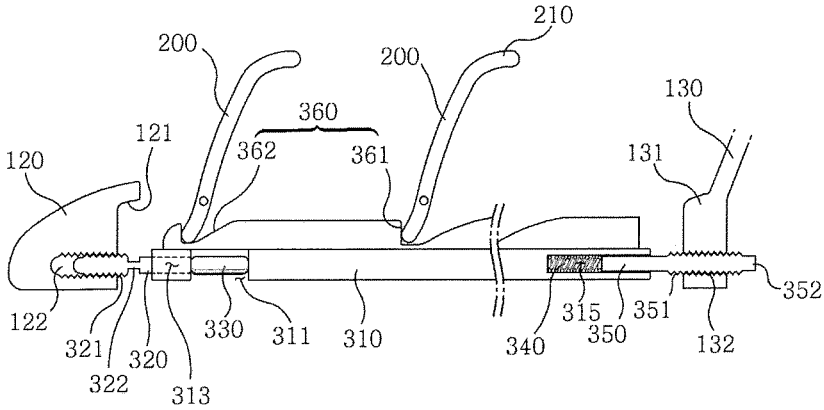
FIG. 7 is a cross sectional view showing a state of a control unit which controls blades of an automatically closed fire protection louver device of the present invention when the blades are in an open state in normal times.
Figure 8:
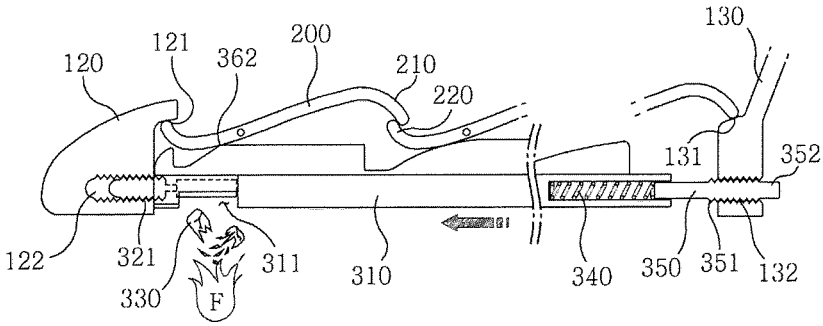
FIG. 8 is a cross sectional view showing a state of a control unit which controls a blade of an automatically closed fire protection louver device of the present invention when the blades are in a closed state when a fire breaks out.

FIG. 6 is a conceptual view comparing advantages and disadvantages according to a cross sectional shape of a blade in an automatically closed fire protection louver device of the present invention, FIG. 7 is a cross sectional view showing a state of a control unit which controls blades of an automatically closed fire protection louver device of the present invention when the blades are in an open state in normal times, and FIG. 8 is a cross sectional view showing a state of a control unit which controls a blade of an automatically closed fire protection louver device of the present invention when the blades are in a closed state when a fire breaks out.

Since the cross section of the blade 20 is formed in an "S" shape as a whole by bending the blade upper portion 210 of the blade 200 backward and bending the blade lower portion 220 forward, the blade upper portion 210 of a fore blade 200 contacts with the blade lower portion 220 of a hind blade 200 so as to be tightly closed when the blades 200 are closed.

That is, the blade 200 is formed in a shape of a plate as a whole, and although the cross section of the blade 200 may be formed in a variety of shapes such as a rectangular shape, an oval shape and the like (hereinafter, referred to as a plane shape) as shown in FIG. 6(*a*), it is most preferably to form the cross section in an "S" shape as shown in FIG. 6(*b*). The reason is that it is economical since efficiency of natural lighting can be maintained high although the space between the blades 200 is extended, and the blades 200 can be closed with a smaller rotation angle compared with a blade of the plane shape when the blades are closed to protect fire, and blockage of the blades can be enhanced since two contacting blades 200 are engaged with each other. In addition, it is preferable to form the blade 200 to be inclined slightly backward from the vertical axis for efficient natural lighting and easy rotation of the blade 200.

Figure 9:
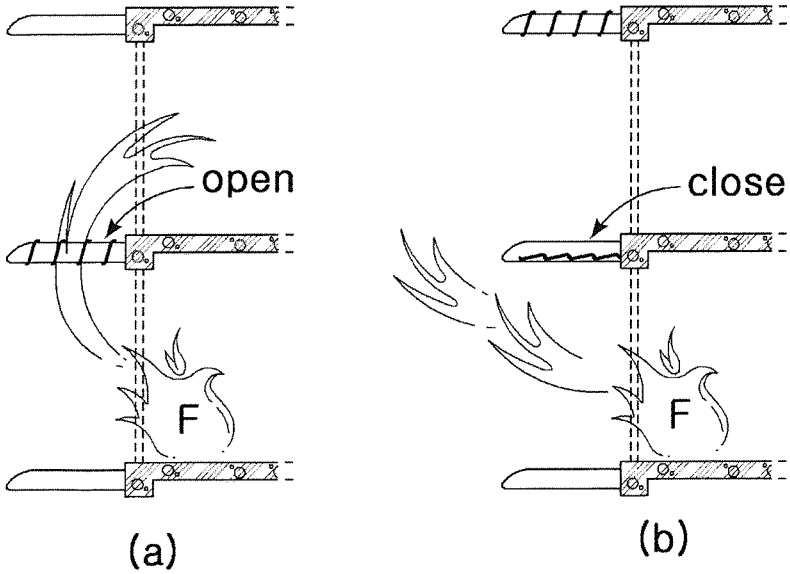
FIG. 9 is a conceptual view showing a state of controlling a direction of flames according to open and closed states of a blade in a multi-story building in which an automatically closed fire protection louver device of the present invention is installed.

FIG. 9 is a conceptual view showing a state of controlling a direction of flames according to open and closed states of a blade in a multi-story building in which an automatically closed fire protection louver device of the present invention is installed.

Although the blade 200 is open in normal times as shown in FIG. 9(*a*), when a fire breaks out, the fuse 330 is broken, and the blade 200 is tightly closed by the forwarding and gravity force of the control unit 300 as shown in FIG. 9(*b*), and thus the automatically closed fire protection louver device of the present invention functions as a fire wall as a whole like a conventional balcony and prevents flames F of a lower floor from spreading to an upper floor.

The present invention provides an automatically closed fire protection louver device, which is installed on a window or the like in an apartment building without a balcony function or in a curtain wall type building structure to adjust natural lighting and automatically block spread of flames to an upper floor without using electrical energy when a fire breaks out.

According to the present invention, the following effects can be expected.

First, there is provided an automatically closed fire protection louver device, which automatically blocks flames of a lower floor spreading to an upper floor without using electrical energy when a fire breaks out in an apartment building without a balcony or a curtain wall type building.

Second, there is provided an automatically closed fire protection louver device, which can enhance thermal energy efficiency by effectively adjusting natural lighting according to the season and provide a cozy indoor environment.

Third, there is provided an automatically closed fire protection louver device, which does not require maintenance cost since power such as electrical energy is not needed and does not need continuous maintenance since it is not easily broken due to simple structure.

Fourth, there is provided an automatically closed fire protection louver device, which can be installed in an existing building as is without separately changing a design.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An automatically closed fire protection louver device installed on an outer surface of a wall or outside of a window, the louver device comprising:

a control unit including a main body formed in a shape of a hollow cylindrical tube having a front end hollow and a rear end hollow, which are hollows, respectively formed at a front end and a rear end, in which a lower portion of the main body is open to form a fuse room connected to the front end hollow, and a plurality of control pins is formed at an upper part of the main body in a row, a fuse inserted in the fuse room and broken by heat at a predetermined temperature, a front side fixing rod inserted in the front end hollow, having a rear end tightly attached to the fuse and a front end exposed to outside of the front end hollow, a spring inserted in the rear end hollow, and a rear side fixing rod inserted in the rear end hollow, having a front end tightly attached to the spring in a state of maintaining a compressive force of the spring and a rear end exposed to outside of the rear end hollow; a plurality of blades, each blade formed substantially planar with an oval cross-section when cut perpendicular to the longitudinal axis of said blade, in which each of the blades has a blade rotation axis protruded at both ends, and a blade lower portion is rested or hinge-coupled in a space between the control pins; and an exterior frame configured of a front side plate formed with a front side fixing rod insertion hole at a center so that a front end of the front side fixing rod may be inserted and fixed in the front side fixing rod insertion hole, a rear side plate formed with a rear side fixing rod insertion hole at a center so that a rear end of the rear side fixing rod may be inserted and fixed in the rear side fixing rod insertion hole, and two side plates respectively formed with a plurality of blade rotation axis insertion holes at regular intervals in a row so that the blade rotation axis may be inserted and rotated, in which both ends of each side plate are installed to be respectively attached to an end of the front side plate and an end of the rear side plate, in which if heat is applied to the fuse when a fire breaks out, the fuse is broken, and the main body moves forward by the spring so that the blade lower portion rested or hinge-coupled in a space between the control pins may move together with the main body, and thus the plurality of blades are rotated and closed.

2. The device according to claim 1, wherein since a cross section of each of the plurality of blades is formed in an "S" shape as a whole by bending an upper portion of each of the plurality of blades backward and bending the blade lower portion forward, the upper portion of a fore blade contacts with the blade lower portion of a hind blade so as to be tightly closed when each of the plurality of blades is closed.

3. The device according to claim 2, wherein since the side plate is further formed with a plurality of blade holders in a row to latch and fix a lower portion of an end of each of the plurality of blades when each of the plurality of blades is opened, and the front end and the rear end of each of the plurality of control pins are respectively further formed with a blade pusher of an inclined shape and a cross-cut blade fixing unit, and a blade lower portion fixing step and a blade upper portion fixing step are further formed at the front side plate and the rear side plate to face each other, when each of the plurality of blades is closed, the blade pusher pushes up and fixes the blade lower portion so that the blade lower portion of a foremost blade may contact with the blade lower portion fixing step so as to be tightly closed and the upper portion a rearmost blade may contact with the blade upper portion fixing step so as to be tightly closed.

4. The device according to claim 3, wherein since the front end of the front side fixing rod is configured of a front side fixing rod male screw and a front side fixing rod adjustment unit and a female screw unit is formed in the front side fixing rod insertion hole, the front side fixing rod male screw unit is engaged with the front side fixing rod insertion hole, and since the rear end of the rear side fixing rod is configured of a rear side fixing rod male screw unit and a female screw unit is formed in the rear side fixing rod insertion hole, the rear side fixing rod male screw unit is engaged in the rear side fixing rod insertion hole.

5. The device according to claim 2, wherein since the front end of the front side fixing rod is configured of a front side fixing rod male screw and a front side fixing rod adjustment unit and a female screw unit is formed in the front side fixing rod insertion hole, the front side fixing rod male screw unit is engaged with the front side fixing rod insertion hole, and since the rear end of the rear side fixing rod is configured of a rear side fixing rod male screw unit and a female screw unit is formed in the rear side fixing rod insertion hole, the rear side fixing rod male screw unit is engaged in the rear side fixing rod insertion hole.

6. The device according to claim 1, wherein since the side plate is further formed with a plurality of blade holders in a row to latch and fix a lower portion of an end of each of the plurality of blades when each of the plurality of blades is opened, and the front end and the rear end of each of the plurality of control pins are respectively further formed with a blade pusher of an inclined shape and a cross-cut blade fixing unit, and a blade lower portion fixing step and a blade upper portion fixing step are further formed at the front side plate and the rear side plate to face each other, when each of the plurality of blades is closed, the blade pusher pushes up and fixes the blade lower portion so that the blade lower portion of a foremost blade may contact with the blade lower portion fixing step so as to be tightly closed and the upper portion a rearmost blade may contact with the blade upper portion fixing step so as to be tightly closed.

7. The device according to claim 6, wherein since the front end of the front side fixing rod is configured of a front side fixing rod male screw and a front side fixing rod adjustment unit and a female screw unit is formed in the front side fixing rod insertion hole, the front side fixing rod male screw unit is engaged with the front side fixing rod insertion hole, and since the rear end of the rear side fixing rod is configured of a rear side fixing rod male screw unit and a female screw unit is formed in the rear side fixing rod insertion hole, the rear side fixing rod male screw unit is engaged in the rear side fixing rod insertion hole.

8. The device according to claim 1, wherein since the front end of the front side fixing rod is configured of a front side fixing rod male screw and a front side fixing rod adjustment unit and a female screw unit is formed in the front side fixing rod insertion hole, the front side fixing rod male screw unit is engaged with the front side fixing rod insertion hole, and since the rear end of the rear side fixing rod is configured of a rear side fixing rod male screw unit and a female screw unit is formed in the rear side fixing rod insertion hole, the rear side fixing rod male screw unit is engaged in the rear side fixing rod insertion hole.

* * * * *